United States Patent [19]

Wong

[11] 3,930,364

[45] Jan. 6, 1976

[54] BRACELET PRIMARILY FOR A WATCH

[75] Inventor: Kwong Wong, Kowloon, Hong Kong

[73] Assignee: Universal Manufacturing Co., Ltd., Hong Kong, Hong Kong

[22] Filed: July 22, 1974

[21] Appl. No.: 490,706

[30] Foreign Application Priority Data

June 27, 1974 United Kingdom ..... 28673/74

[52] U.S. Cl. ..... 59/80; 63/4; 224/4 H

[51] Int. Cl.[2] ..... F16G 15/14

[58] Field of Search ..... 59/80, 82, 79 R, 79 B; 63/4; 224/4 E, 4 D, 4 H

[56] References Cited

UNITED STATES PATENTS

| | | | |
|---|---|---|---|
| 2,480,015 | 8/1949 | Goode | 59/91 |
| 3,195,301 | 7/1965 | Bello | 59/80 |
| 3,425,214 | 2/1969 | Meng | 59/80 |
| 3,609,963 | 10/1971 | Ichinose | 59/80 |

FOREIGN PATENTS OR APPLICATIONS

| | | | |
|---|---|---|---|
| 1,086,074 | 7/1960 | Germany | 59/79 R |

*Primary Examiner*—C. W. Lanham
*Assistant Examiner*—Gene P. Crosby
*Attorney, Agent, or Firm*—Wenderoth, Lind & Ponack

[57] ABSTRACT

A bracelet primarily for a watch incorporates at least one link which can be disconnected from a neighbouring link to allow a unit to be added to or removed from the bracelet to alter its length. The unit consists of a link and a pivot element which is pivotally attached by one end to one end of the link and the other end of which has a pair of pivot projections for attachment to another link, e.g. of a similar unit. The said one link has at one end a pair of sockets facing opposite sides of the bracelet and these sockets have slots at their sides remote from said one end to enable the said pair of pivot projections on the pivot element of the unit to be engaged in and disengaged from the sockets. The said one link has a release member pivoted to it for movement into and out of a position in which a portion of the link blocks the slots to prevent disengagement of the pivot projections from the sockets.

12 Claims, 9 Drawing Figures

BRACELET PRIMARILY FOR A WATCH

This invention relates to bracelets and links therefor and more particularly but not exclusively to watch bracelets and links therefor.

According to this invention there is provided a bracelet link having at each end thereof a pair of aligned sockets for receiving hinge projections which sockets face opposite edges of the link, slots opening to the sockets of one pair at the side thereof nearer the other pair of sockets, a release member pivotally mounted on said link, which release member is movable into a first position in which portions of the member close off said slots and into a second position in which said portions are disposed away from the slots.

The invention further provides a bracelet comprising a plurality of links, and pivot elements hinging the links together, each pivot element extending between adjoining ends of two links and having at each end two hinge projections extending coaxially with each other towards opposite side edges of the bracelet and each of the two links joined by the pivot element having at its end adjacent the other link respective sockets into which the two hinge projections at the adjoining end of the element project, at least one of the links in the bracelet having slots which open to the sockets at one end thereof at the side of the sockets nearer the other end of said one link, and a member pivotally mounted on said one link and movable into a first position in which portions of the member are engaged in the slots and close off said sockets and into a second position in which said portions are disposed away from the slots enabling the projections to be disengaged from the sockets.

One embodiment of the invention will now be described in more detail by way of example with reference to the accompanying drawings in which.

Figure 3:
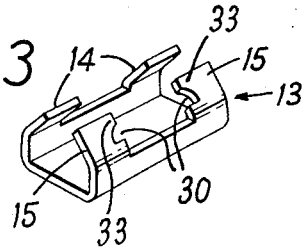
Figure 4:
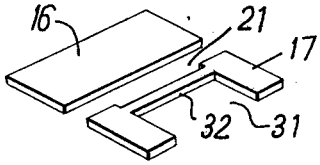
Figure 5:
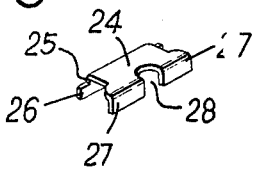
Figure 6:
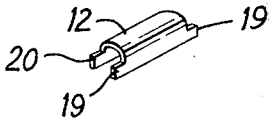
Figure 7:
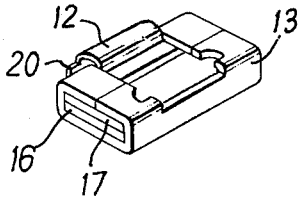
Figure 8:
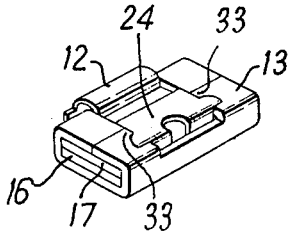
Figure 9:
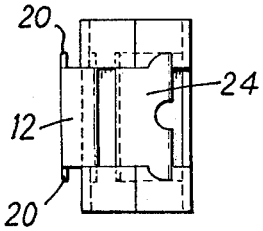

FIGS. 3 to 5 respectively show components of a link according to the invention;

FIG. 6 shows a pivot element for interconnecting the links;

FIGS. 7 and 8 respectively show an intermediate stage in the assembly of the link and pivot element and the completed assembly, and FIG. 9 shows a plan view corresponding to FIG. 8.

Figure 1:
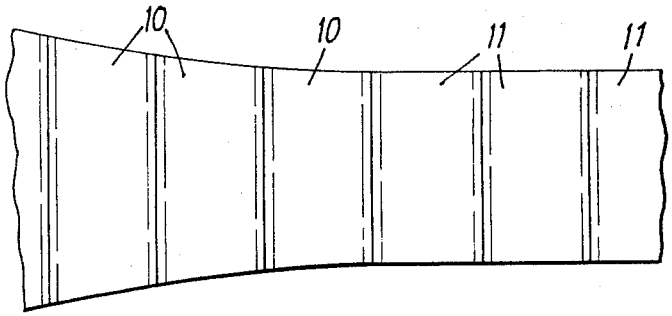
FIG. 1 shows the face side of part of a bracelet according to the invention.
Figure 2:
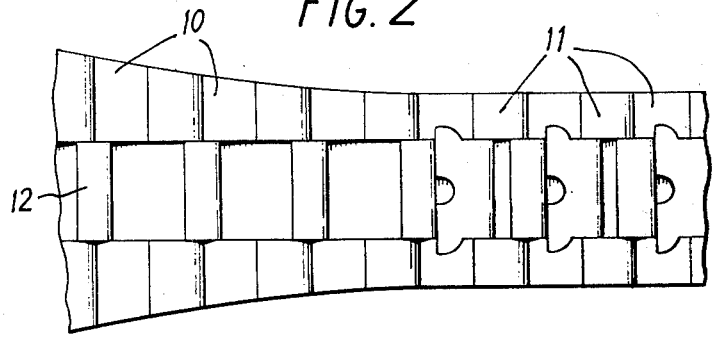
FIG. 2 shows the reverse side corresponding to FIG. 1.

Referring to FIGS. 1 and 2 a bracelet comprises a plurality of links 10 which are permanently hinged together and a plurality of links 11 which are detachable from and insertable into the bracelet to enable its length to be adjusted. The links 10 and 11 are hinged together by pivot elements 12 disposed on the reverse side of the bracelet.

Each link 11 is constructed from sheet metal components similar to those shown in FIGS. 3 to 6. The face side of each link is provided by a shell 13 having pairs of tabs 14, 15 at its ends. The shell first has its end portions turned up as shown in FIG. 3 and a rectangular plate member 16 and a notched plate member 17 are placed one above the other between the tabs, member 17 being uppermost. A pivot element 12 of bowed shape and having pairs of projections 19, 20 at its ends as shown in FIG. 6 is placed with one end edge in the shallower notch 21 of plate member 17. The tabs 14, 15 are now pressed down to give the structure shown in FIG. 7. The width of the body of the pivot element 12, i.e. its dimension widthwise of the bracelet is slightly less than the distance between the tabs 14, but the overall width of the element 12 is greater than the said distance and is slightly less than the width of the notch 21. The projections 19 are thus disposed in sockets formed jointly by the shell and members 16 and 17.

A release member 24 is shown in FIG. 5 and has at one end a turned down portion 25 which has outward pivot projections 26 at its bottom edge. The other end of member 24 is curved downwardly and back on itself and two outward projections 27 are formed on the curved portion. The curved end of the member 24 is formed with a cutout 28.

Tabs 15 of the shell are formed with slots 30 on their adjacent edges, and to attach the release member 24 thereto, its projections 26 are inserted through the slots 30 of the assembly shown in FIG. 7 so as to be engaged in the deeper notch 31 of plate member 17, and the member is then slid towards the other end of the link until it abuts the bar 32 separating the notches of member 17. The portions 33 of tabs 15, between the notches 30 and the free ends of the tabs are then deformed downward to retain the projections 26 in place. Thus the shell and the plate members 16 and 17 jointly also provide sockets for the pivot projections 26 of release element 24, enabling the element to be rotated into and out of a position in which the projections 27 extend through the slots 30 and across the notch 31 of the underlying plate member 17. The curved surfaces of the projections 27 co-operate with the edges of slots 30 to provide a snap action movement into and out of said position, and the cutout 28 provides a purchase for the tip of a penknife blade or other pointed tool to prise the free edge of element 24 upward.

When the projections 27 are clear of the notches 30 the projections 20 of the connecting pivot element 12 of a similar link can be inserted through the notches 30 and then moved to the open end of notch 31 where they abut the end parts of the shell. The shell and plate members 16 and 17 thus also provide sockets for the projections 20. The slots 30 giving access to the sockets are then closed off by returning the release member to its position in which the projections 27 are engaged in the slots.

The links 10 are constructed in a similar way to links 11, but do not incorporate release member 24. Consequently the shells of the links 10 do not have slots 30, and their plate members have two shallow notches 21 instead of shallow and deep notches 21, 31 so that the links are symmetrical, and the pivot projections 19, 20 of the pivot elements 12 are permanently locked in the sockets in the links. It will be understood therefore that the first link 11 is permanently attached by its pivot element 12 to the links 10.

I claim:

1. A bracelet link having at each end thereof a pair of aligned sockets for receiving hinge projections which sockets face opposite side edges of the link, slots opening to the sockets of one pair at the side thereof, a release member pivotally mounted on said link, which release member is movable into a first position in which portions of the member close off said slots and into a second position in which said portions are disposed away from the slots.

2. A bracelet link as claimed in claim 1, wherein said release member is movable into and out of said first position with a snap action.

3. A bracelet link as claimed in claim 1, further comprising a pivot element connected thereto and adapted to connect the link pivotally to a similar link, said element having at one end thereof a pair of projections engaging in the sockets of the other pair and having at its other end a pair of projections adapted for engagement in the slotted sockets of a similar link.

4. a bracelet link as claimed in claim 3, wherein the sockets of each pair face towards each other.

5. a bracelet link as claimed in claim 4, wherein the link is of sandwich construction comprising a shell having a face portion and, at each end of the face portion, a pair of tabs which are spaced from each other, and an inner plate member about which the pairs of tabs are folded and each end edge of which has a central notch wider than the distance between the tabs whereby the sockets are formed between the tabs and the outer side of the shell, the notch at one end of the plate member having a greater depth than the notch at the other end and the tabs engaging said one end of the plate member having said slots formed in their edges nearest each other which slots are spaced away from the end of the link, and said release member being arranged so that said portions thereof are movable through the slots in the tabs to block, in the first position of the release member, movement of the projections of a pivot element out of the sockets and through the slots in the tabs.

6. A bracelet link as claimed in claim 5, wherein said release member is made from sheet metal, the metal being curved back on itself at one end of the release member and having projections formed at said one end thereof, whereby the projections have curved faces, the slots in the tabs having edges which are engaged by the curved faces of the projections to provide a snap action of the release member into and out of said first position.

7. A bracelet link as claimed in claim 5, wherein the deeper notch in the plate member extends beyond the slotted tabs and the release member has a pair of aligned pivot projections which are engaged in the deeper notch beyond the slotted tabs and which are retained therein by the other tabs and by free end portions of the slotted tabs which are deformed upon the deeper notch.

8. A bracelet comprising a plurality of links, and pivot elements hinging the links together, each pivot element extending between adjoining ends of two links and having at each end two hinge projections extending coaxially with each other towards opposite side edges of the bracelet and each of the two links joined by the pivot element having at its end adjacent the other link respective sockets into which the two hinge projections at the adjoining end of the element project, at least one of the links in the bracelet having slots which open to the sockets at one end thereof at the side of the sockets and a release member pivotally mounted on said one link and movable into a first position in which poritions of the member are engaged in the slots and close off said sockets and into a second position in which said portions are disposed away from the slots enabling the projections to be disengaged from the sockets.

9. A bracelet as claimed in claim 8, wherein said one link has its sockets of each pair facing towards each other.

10. a bracelet as claimed in claim 9, wherein said one link is of sandwich construction comprising a shell having a face portion and, at each end of the face portion, a pair of tabs which are spaced from each other, and an inner plate member about which the pairs of tabs are folded and each end edge of which has a central notch wider than the distance between the tabs whereby the sockets are formed between the tabs and the outer side of the shell, the central notch at one end of the plate member having a greater depth than the notch at the other end and the tabs engaging said one end of the plate member having said slots formed in their edges nearest each other which slots are spaced away from the end of the link, and said release member being arranged so that said portions thereof are movable through the slots in the tabs to block, in the first position of the release member, movement of the projections of a pivot element out of the sockets and through the slots in the tabs.

11. A bracelet as claimed in claim 10, wherein said release member is made from sheet metal, the metal being curved back on itself at one end of the release member and having projections formed at said one end thereof, whereby the projections have curved faces, the slots in the tabs having edges which are engaged by the curved faces of the projections to provide a snap action of the release member into and out of said first position.

12. A bracelet as claimed in claim 10, wherein the deeper notch in the plate member extends beyond the slotted tabs and the release member has a pair of aligned pivot projections which are engaged in the deeper notch beyond the slotted tabs and which are retained therein by the other tabs and by free end portions of the slotted tabs which are deformed upon the deeper notch.

* * * * *